US011568808B2

(12) United States Patent
Shim et al.

(10) Patent No.: US 11,568,808 B2
(45) Date of Patent: Jan. 31, 2023

(54) ORGANIC LIGHT EMITTING DISPLAY DEVICE

(71) Applicant: LG DISPLAY CO., LTD., Seoul (KR)

(72) Inventors: JongSik Shim, Goyang-si (KR); MooKyoung Hong, Jinhae-si (KR); Boeon Byeon, Gwangju (KR)

(73) Assignee: LG DISPLAY CO., LTD., Seoul (KR)

( * ) Notice: Subject to any disclaimer, the term of this patent is extended or adjusted under 35 U.S.C. 154(b) by 458 days.

(21) Appl. No.: 14/524,733

(22) Filed: Oct. 27, 2014

(65) Prior Publication Data

US 2015/0130865 A1 May 14, 2015

(30) Foreign Application Priority Data

Nov. 13, 2013 (KR) ..... 10-2013-0137613

(51) Int. Cl.
*G09G 3/3233* (2016.01)

(52) U.S. Cl.
CPC ... *G09G 3/3233* (2013.01); *G09G 2300/0842* (2013.01); *G09G 2320/043* (2013.01)

(58) Field of Classification Search
CPC ..... G09G 3/3233
See application file for complete search history.

(56) References Cited

U.S. PATENT DOCUMENTS

2003/0063081 A1* 4/2003 Kimura ..... G09G 3/3233 345/211
2004/0150592 A1* 8/2004 Mizukoshi ..... G09G 3/3233 345/76
2004/0239596 A1* 12/2004 Ono ..... G09G 3/3233 345/76
2005/0258997 A1* 11/2005 Kim ..... G09G 3/3688 341/155
2006/0149493 A1* 7/2006 Sambandan ..... G09G 3/3233 702/118
2007/0210996 A1* 9/2007 Mizukoshi ..... G09G 3/3233 345/77
2008/0001855 A1* 1/2008 Hamer ..... G09G 3/3233 345/76
2008/0111812 A1* 5/2008 Shirasaki ..... G09G 3/3233 345/212
2009/0081816 A1* 3/2009 Yamazaki ..... G09G 3/006 438/10

(Continued)

FOREIGN PATENT DOCUMENTS

CN 103165076 A 6/2013
CN 103165078 A 6/2013

(Continued)

OTHER PUBLICATIONS

Swartz, "Mean, median, and Mode; Measuring Central Tendency and Skew in Bell Curves" downloaded from https://hubpages.com/education/Mean-median-and-Mode-Measuring-Central-Tendancy, on Mar. 30, 2016.*

(Continued)

*Primary Examiner* — Dorothy Harris
(74) *Attorney, Agent, or Firm* — Dentons US LLP

(57) ABSTRACT

The present invention relates to an organic light emitting display device that changes a reference voltage commonly applied to a driving transistor in all pixels, based on a characteristic value sensed according to each pixel.

5 Claims, 12 Drawing Sheets

(56) References Cited

U.S. PATENT DOCUMENTS

| | | | | |
|---|---|---|---|---|
| 2009/0106714 | A1* | 4/2009 | Culp | G01R 31/26 716/106 |
| 2010/0245343 | A1* | 9/2010 | Takei | G09G 3/3241 345/214 |
| 2011/0227505 | A1* | 9/2011 | Park | H05B 33/0896 315/297 |
| 2013/0050292 | A1* | 2/2013 | Mizukoshi | G09G 3/3291 345/690 |
| 2013/0147693 | A1 | 6/2013 | Bae | |
| 2013/0147694 | A1 | 6/2013 | Kim et al. | |
| 2014/0028859 | A1* | 1/2014 | Kim | G09G 3/30 348/189 |
| 2016/0055791 | A1* | 2/2016 | Kishi | G09G 3/3241 345/212 |

FOREIGN PATENT DOCUMENTS

| | | | |
|---|---|---|---|
| CN | 103165079 | A | 6/2013 |
| CN | 103177685 | A | 6/2013 |
| CN | 103187021 | A | 7/2013 |
| KR | 10-2012-0054175 | A | 5/2012 |

OTHER PUBLICATIONS

Wikipedia article Normal distribution downloaded from https://en.wikipedia.org/wiki/Normal_distribution, on Mar. 30, 2016.*

* cited by examiner

ORGANIC LIGHT EMITTING DISPLAY DEVICE

CROSS-REFERENCE TO RELATED APPLICATION

This application claims priority from and the benefit under 35 U.S.C. § 119(a) of Korean Patent Application No. 10-2013-0137613, filed on Nov. 13, 2013, which is hereby incorporated by reference for all purposes as if fully set forth herein.

BACKGROUND OF THE INVENTION

Field of the Invention

The present invention relates to an organic light emitting display device.

Description of the Prior Art

The organic light emitting display device has come more into the spotlight as a display device due to advantages of a fast response rate, high light emitting efficiency, high luminance and a wide viewing angle because of its use of an Organic Light Emitting Diode (OLED) which self-emits light.

In such an organic light emitting display device, pixels including organic light emitting diodes respectively are arranged and brightness of selected pixels by a scan signal is controlled depending on gradation of data.

Each pixel of the organic light emitting device includes a driving transistor for driving the OLED, besides the OLED. The driving transistor has a specific characteristic value such as a threshold voltage and a mobility.

The characteristic value of the driving transistor may be changed according to an increase of time, and in this case, luminance quality of a corresponding pixel may be degraded.

In addition, characteristic changes of the driving transistors in the each pixel may be different, and in this case, a dispersion in which the characteristic values of the driving transistors are distributed occurs.

The dispersion of the characteristic value of the driving transistor may degrade reliability of the driving transistor, furthermore, may have a large effect on a reliability and a lifetime of a display panel, and may largely degrade overall quality of an organic light emitting display device.

SUMMARY OF THE INVENTION

An aspect of the present invention is to provide an organic light emitting display device capable of effectively compensating for a dispersion and a dispersion shift of a characteristic of a driving transistor.

In accordance with an aspect of the present invention, an organic light emitting display device includes a sensing unit that senses a characteristic value of a driving transistor in each pixel of a display panel; and a compensation unit that controls to change a reference voltage commonly applied to a driving transistor in all pixels, based on the characteristic value sensed according to the each pixel.

In accordance with another aspect of the present invention, an organic light emitting display device includes a display panel comprising data lines and gate lines defining a plurality of pixels; a data driving unit that provides a data voltage to the data lines; and a power providing unit that changes and provides a reference voltage commonly provided to a driving transistor in the plurality of the each pixels.

According to the present invention, an organic light emitting display device capable of effectively compensating for a dispersion and a dispersion shift of a characteristic value of a driving transistor can be provided.

In addition, according to the present invention, an organic light emitting display device capable of preventing a phenomenon in which an undesirable color is displayed according to a characteristic value shift of a driving transistor, through a dispersion change compensation, can be provided.

In addition, according to the present invention, a display panel and an organic light emitting display device of which a reliability is high and a lifetime is long can be provided, through an effective pixel compensation.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
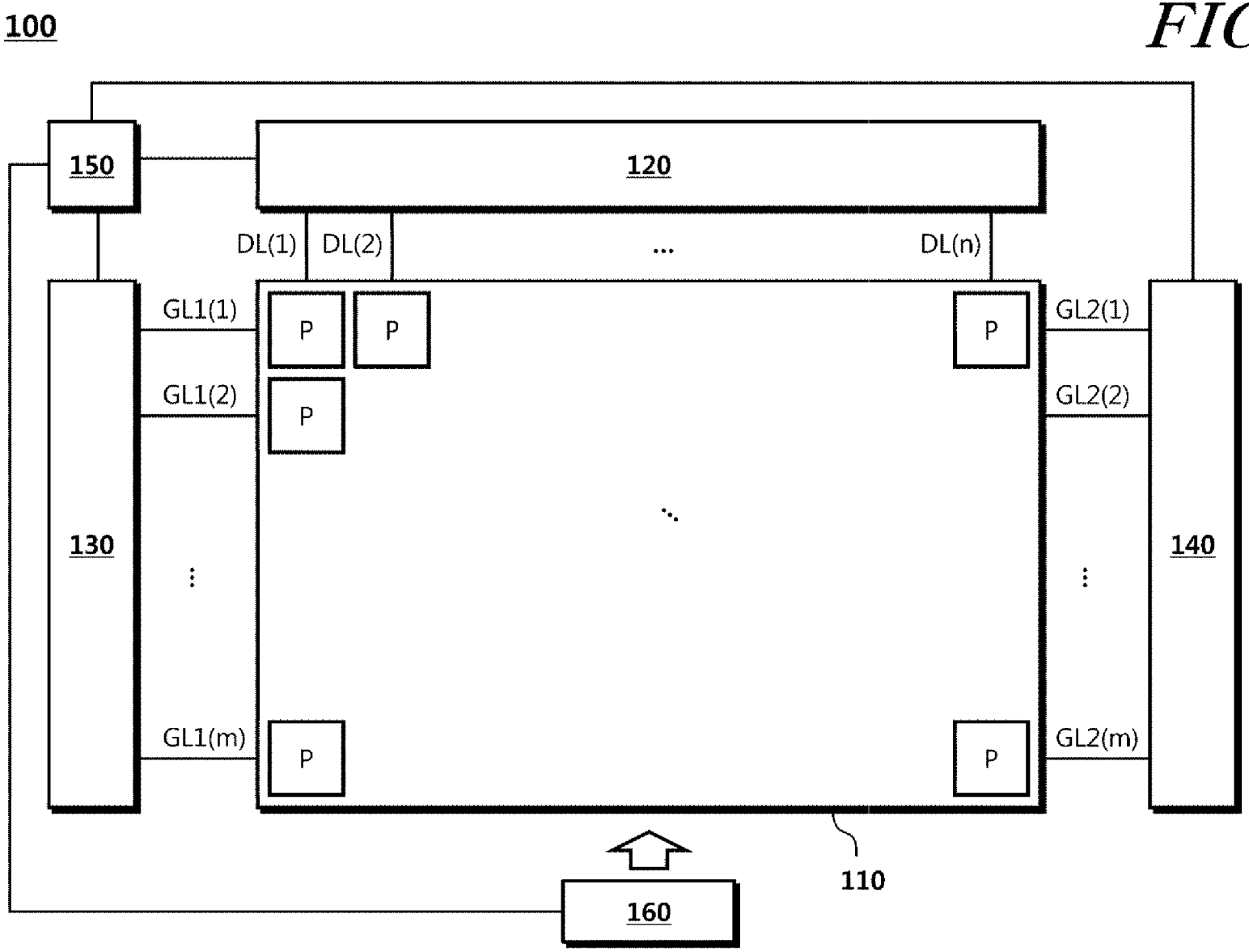
FIG. 1 schematically illustrates a system of an organic light emitting display device according to an embodiment.

Hereinafter, exemplary embodiments of the present invention will be described with reference to the accompanying drawings. In the following description, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 schematically illustrates a system of an organic light emitting display device 100 according to an embodiment.

Referring to FIG. 1, the organic light emitting display device 100 according to an embodiment includes a display panel 110, a data driving unit 120, a first gate driving unit 130, a second gate driving unit 140, a timing controller 150 and a power providing unit 160.

Data lines DL(1), DL(2), . . . , DL(n) and gate lines GL1(1), GL1(2), . . . , GL1(*m*) and GL2(1), GL2(2), . . . , GL2(*m*) are formed on the display panel 110, and a plurality of pixels P is defined by crossings of the data lines DL(1), DL(2), . . . , DL(n) and the gate lines GL1(1), GL1(2), . . . , GL1(*m*) and GL2(1), GL2(2), . . . , GL2(*m*).

The data driving unit 120 provides a data voltage to the data lines DL(1), DL(2), . . . , DL(n).

The first gate driving unit 130 sequentially supplies a first scan signal to first gate lines GL1(1), GL1(2), . . . , GL1(*m*) among the gate lines GL1(1), GL1(2), . . . , GL1(*m*) and GL2(1), GL2(2), . . . , GL2(*m*).

The second gate driving unit 140 sequentially supplies a second scan signal to second gate lines GL2(1), GL2(2), . . . , GL2(*m*) among the gate lines GL1(1), GL1(2), . . . , GL1(*m*) and GL2(1), GL2(2), . . . , GL2(*m*).

The timing controller 150 controls a driving timing of the data driving unit 120, the first gate driving unit 130, and the second gate driving unit 140, and outputs variable control signals for controlling the driving timing.

The first gate driving unit 130 and the second driving unit 140 may be separately implemented, and in some cases, may be implemented as one gate driving unit.

The above-mentioned first gate driving unit 130 may be positioned on only one side of the display panel 110 as illustrated in FIG. 1 or may be divided into two units and positioned on both sides of the display panel 110, depending on a driving scheme of the first gate driving unit 130. The second gate driving unit 140 may be located in a similar manner to that of the first gate driving unit 130.

Further, the first gate driving unit 130 and the second gate driving unit 140 may include a plurality of gate driving integrated circuits which may be connected to a bonding pad of the display panel 110 in a tape automated bonding manner or a chip on glass manner, or implemented in a gate in panel (GIP) type so as to be directly formed on the display panel 110. The data driving unit 120 may include a plurality of gate driving ICs (may be referred to as source driving IC). The plurality of data driving ICs may be connected to a bonding pad of the display panel 110 in the TAB manner or the COG manner. Alternatively, the plurality of data driving ICs may be directly formed on the display panel 110 in the GIP type.

In addition, the power providing unit 160 may provide to each pixel with a common voltage such as a reference voltage Vref, a driving voltage EVDD and a base voltage EVSS.

Thus, each pixel P may be connected to one data line DL and two gate lines GL1 and GL2, and may receive the common voltage such as the reference voltage Vref, the driving voltage EVDD and the base voltage EVSS.

Figure 2:
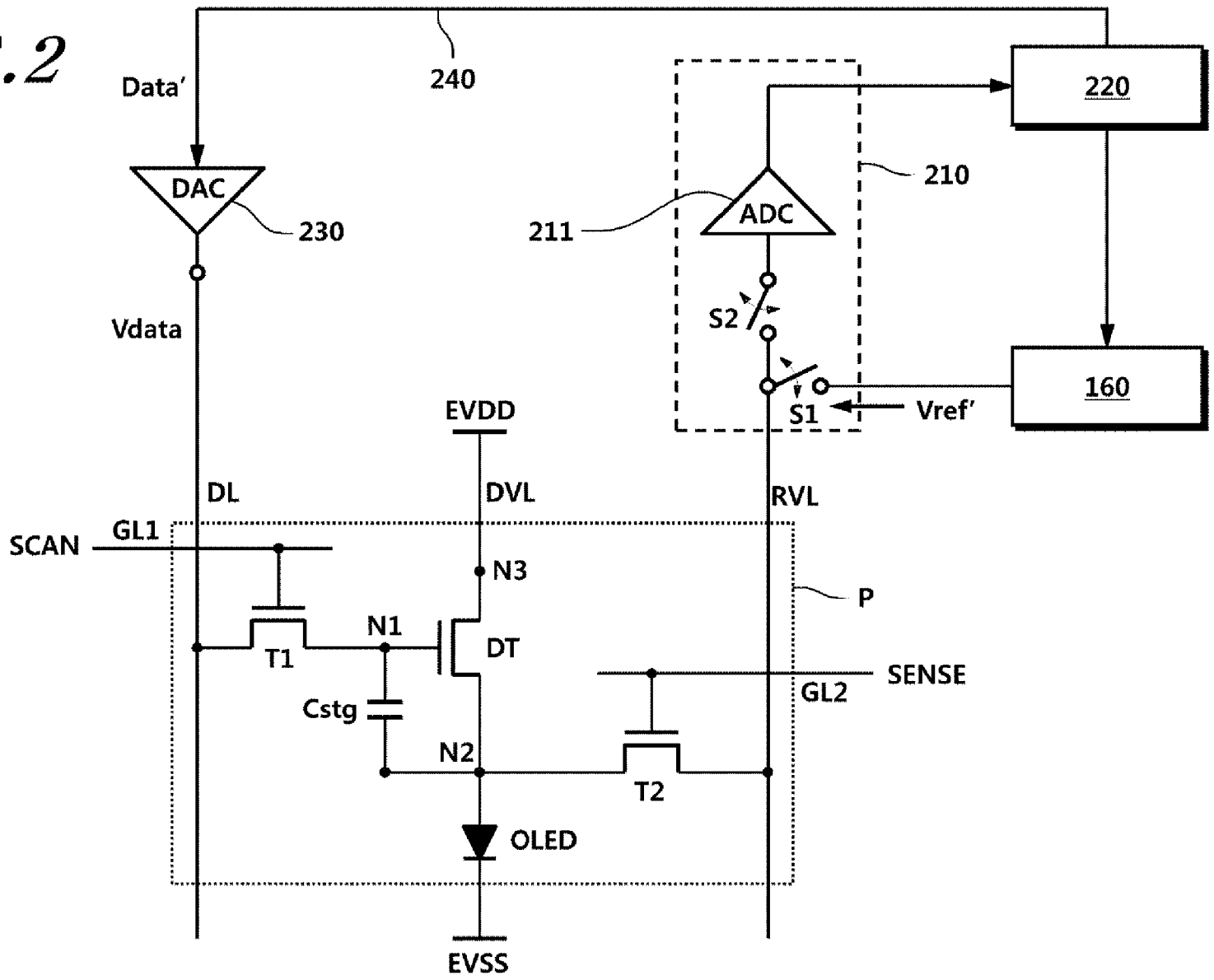
FIG. 2 illustrates a pixel structure of the organic light emitting display device according to an embodiment.

Each pixel structure in the organic light emitting display device according to an embodiment is illustrated in FIG. 2, and each pixel structure is described below with reference to FIG. 2.

FIG. 2 is a view illustrating a pixel structure of the organic light emitting display device according to an embodiment.

Referring to FIG. 2, each pixel P of the organic light emitting display device 100 according to an embodiment includes an Organic Light Emitting Diode (OLED) and a driving circuit unit for driving the OLED.

Referring to FIG. 2, the driving circuit unit for driving the OLED in each pixel P includes a driving transistor DT for providing a current to the OLED, a first transistor T1 as a switching transistor which controls a turning-on or a turning-off of the driving transistor DT by controlling an application of a data voltage Vdata to a first node N1 of the driving transistor under a control of a first scan signal SCAN, and a storage capacitor Cstg which maintains the data voltage Vdata applied to the first node N1 of the driving transistor DT during one frame. The driving circuit unit may further include a second transistor T2 as a sensing transistor for sensing a characteristic value of the driving transistor DT. Here, the second transistor T2 provides a reference voltage Vref to a second node N2 of the driving transistor DT. The characteristic value of the driving transistor DT may include at least one of a threshold voltage (Vth) and a mobility.

Referring to FIG. 2, a connecting structure of three transistors DT, T1 and T2 and one capacitor Cstg will be further described.

Referring to FIG. 2, the driving transistor DT has three nodes N1, N2 and N3 as transistors for driving the OLED. The first node N1 of the driving transistor DT is connected to the first transistor T1, the second node N2 of the driving transistor DT is connected to an anode (or a cathode) of the OLED, and the third node N3 of the driving transistor DT is connected to a driving voltage line DVL to which a driving voltage VDD is provided.

The first transistor T1 is controlled by the first scan signal SCAN provided from the first gate line GL1, and is connected between the data line DL and the first node N1 of the driving transistor DT.

The first transistor T1 receives the data voltage Vdata output from a Digital Analog Converter (DAC) 230 in the data driving unit 120 through the data line DL, and applies the data voltage Vdata to the first node N1 of the driving transistor DT.

The second transistor T2 is controlled by a second scan signal SENSE provided from the second gate line GL2, and is connected between the second node of the driving transistor DT and a reference voltage line RVL for providing the reference voltage Vref to the second node N2 of the driving transistor DT.

The storage capacitor Cstg is interposed between and connected to the first node N1 and the second node N2 of the driving transistor DT.

According to the embodiment, the driving transistor DT may be an N type transistor or a P type transistor. If the driving transistor DT is the N type transistor, the first node N1 may be a gate node, the second node N2 may be a source node, and the third node N3 may be a drain node. If the driving transistor DT is the P type transistor, the first node N1 may be a gate node, the second node N2 may be a drain node, and the third node N3 may be a source node. In the description and drawings according to the embodiment, for convenience of description, the driving transistor DT and the first and second transistors T1 and T2 connected to the driving transistor DT are illustrated as the N type transistor. Accordingly, it is described that the first node N1 of the driving transistor DT is the gate node, the second node N2 is the source node, and the third node N3 is the drain node.

Meanwhile, the driving transistor in each pixel may have a threshold voltage and a mobility as a specific characteristic value. The characteristic value of the driving transistor DT in each pixel may be changed according to an increase of time, and change levels of each driving transistor DT may become different gradually, and thus the characteristic values of the driving transistors DT of all pixels may not be the same and may be dispersed.

Figure 3:
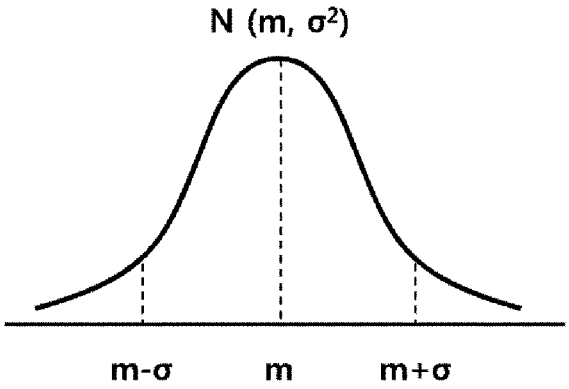
FIG. 3 illustrates a dispersion of a characteristic value of a driving transistor DT in each pixel of an organic light emitting display device according to an embodiment.

FIG. 3 is a view for describing a dispersion for a characteristic value of a driving transistor DT in each pixel of an organic light emitting display device 100 according to an embodiment.

Referring to a dispersion curve of FIG. 3, when all characteristic values of the driving transistors DT in each pixel in the organic light emitting display device 100 according to an embodiment is collected, the characteristic values of the driving transistors DT may not be the same and be dispersed. In this case, the characteristic values of the driving transistors are statistically dispersed with an average value of m and a deviation of σ.

⇒ Threshold voltage (Vth)~N(m, σ2)

⇒ Mobility (K)~N(m, σ2)

A state in which the characteristic values of the driving transistors are dispersed as shown in FIG. 3 is referred to as a dispersion. A measure of dispersion which is a level of the dispersion may be defined with the average value (m) and the deviation (σ).

Meanwhile, the dispersion of the characteristic values of the driving transistors may be shifted. This is referred to as a dispersion shift. Here, the dispersion shift corresponds to an average value change of a dispersion change (e.g., an average value change and deviation change). Hereinafter, the dispersion shift may be referred to as a dispersion change or an average value change.

Figure 4:
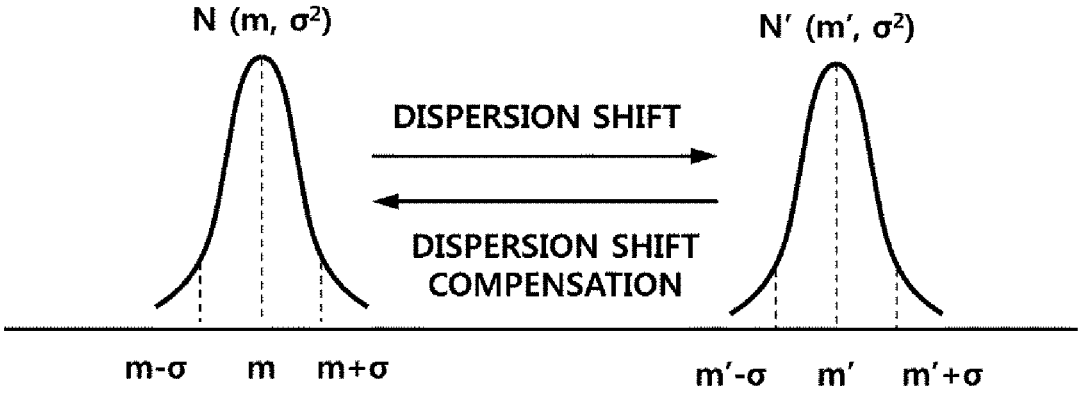
FIG. 4 is a dispersion curve illustrating a dispersion shift and a compensation for the dispersion shift of a characteristic value of a driving transistor in each pixel of an organic light emitting display device according to an embodiment.

FIG. 4 is a dispersion curve illustrating a dispersion shift and a compensation for the dispersion shift for a characteristic value of a driving transistor DT in each pixel of an organic light emitting display device 100 according to an embodiment.

Referring to FIG. 4, when a dispersion in which characteristic values of the driving transistors DT in each pixel is dispersed as an average value of m and a deviation of σ (N(m, σ2)), the average value of the characteristic values of the driving transistors DT in each pixel is changed into m', and the dispersion is changed (N'(m', σ2)), and thus a dispersion shift may occur.

The dispersion shift as well as the dispersion of the characteristic of the driving transistor described above may degrade a reliability of the driving transistor, furthermore, may have a large effect on a reliability and a lifetime of a display panel 110, and may largely degrade an overall quality of an organic light emitting display device 100.

Thus, in order to improve a quality of the organic light emitting display device 100 by increasing a reliability of the driving transistor DT and the display panel 110 and lengthening a lifetime of the driving transistor DT and the display panel 110, compensating for the dispersion shift of the characteristic of the driving transistor DT in each pixel is important.

To this end, referring to FIG. 2, the organic light emitting display device 100 according to an embodiment may include a sensing unit 210 which senses the characteristic value of the driving transistor DT in each pixel of the display panel 110, and a compensation unit 220 which calculates a dispersion change based on the sensed characteristic value to compensate for the dispersion change.

Referring to FIG. 2, the sensing unit 210 may be disposed in correspondence to each pixel column, that is each data line. The sensing unit 210 may be disposed in the data driving unit 120.

The sensing unit 210 may include an Analog/Digital Converter (ADC) 211 which measures a voltage capable of sensing the characteristic value of the driving transistor DT in a corresponding pixel, converts the voltage into a digital value, and switches S1 and S2 which selectively connects one of the ADC 211 and the power providing unit 160 providing the reference voltage Vref with the reference voltage line RVL transferring the reference voltage Vref to the corresponding pixel.

The switch which selectively connects one of the power providing unit 160 and the ADC 211 with the reference voltage line RVL may be implemented as one switch. Alternatively, the switch may be implemented as two switches.

When the switch is implemented as two switches S1 and S2, a connection structure of the two switches is described. The first switch S1 is connected between the reference voltage line RVL and the power providing unit 160, and the second switch S2 is connected between the reference voltage line RVL and the ADC 210.

Switching operations of turning-on and turning-off of the two switches S1 and S2 are different according to whether a corresponding pixel is operated as a driving mode or a sensing mode.

When the pixel is operated as the driving mode, if the first switch S1 is turned-on, the first switch S1 connects the reference voltage line RVL with the power providing unit 160, and thus the reference voltage Vref output from the power providing unit 160 may be provided to the second node N2 of the driving transistor DT. At this time, the second switch S2 is turned-off.

When the pixel is operated as the sensing mode, if the first switch S1 is turned-on, the static voltage Vref is applied to the second node N2 of the driving transistor DT. Then, if the first switch S1 is turned-off, simultaneously, the second switch S2 is turned-on, and thus the ADC 210 may measure a voltage of the second node N2 of the driving transistor DT. A characteristic value (e.g., threshold voltage and mobility) of the driving transistor DT may be sensed from the voltage measured this time.

The above-mentioned compensation unit 220 may provide a compensation scheme which changes a data voltage provided to each pixel, when the compensation unit 220 compensates for the characteristic value (e.g., threshold voltage and mobility) of the driving transistor DT of each pixel.

However, such a compensation scheme is a scheme in which compensation is performed according to each pixel, as a scheme which changes a data voltage provided to each pixel. Such an individual pixel compensation scheme may compensate for a dispersion itself. That is, the individual pixel compensation scheme may reduce a difference (i.e. deviation) between the characteristic values of the pixels. However, there is a limit in compensating for a dispersion shift in which the overall characteristic values of each pixel are shifted, by the individual pixel compensation scheme.

Thus, the compensation unit 220 may provide an integrated pixel compensation scheme which changes a common voltage commonly provided to all pixels and capable of changing the characteristic of the driving transistor DT, in addition to the individual pixel compensation scheme through the data voltage change.

Thus, the compensation unit 220 may provide the integrated pixel compensation scheme which changes the reference voltage Vref which is the common voltage applied to the second node N2 of the driving transistor DT as a DC voltage to compensate all pixels. Here, the compensation unit 220 may be the timing controller 150, may be included in the timing controller 150, or may be a separate construction disposed outside the timing controller 150.

To this end, as shown in FIG. 2, in the organic light emitting display device 100 according to an embodiment, the sensing unit 210 may sense the characteristic value of the driving transistor DT in each pixel. The compensation unit 220 may control to change the reference voltage commonly applied to the driving transistor DT in all pixels, based on the characteristic value sensed according to each pixel. The power providing unit 160 may change the reference voltage under a control of the compensation unit 220 and provide the changed reference voltage Vref' to all pixels of the display panel 110.

When the integrated pixel compensation scheme through the reference voltage change is applied, in a state wherein a dispersion shift (e.g., average value shift) in which an average value of the characteristic of the driving transistor DT is shifted from m to m' occurs, the average value can be compensated from m' to m (i.e., desired level), as shown in FIG. 4. That is, the dispersion shift (i.e., average value shift compensation) is possible.

The above-mentioned integrated pixel compensation scheme through the reference voltage change, which can compensate for the dispersion shift of the characteristic value of the driving transistor is described in more detail with reference to FIGS. 5 and 6.

Figure 5:
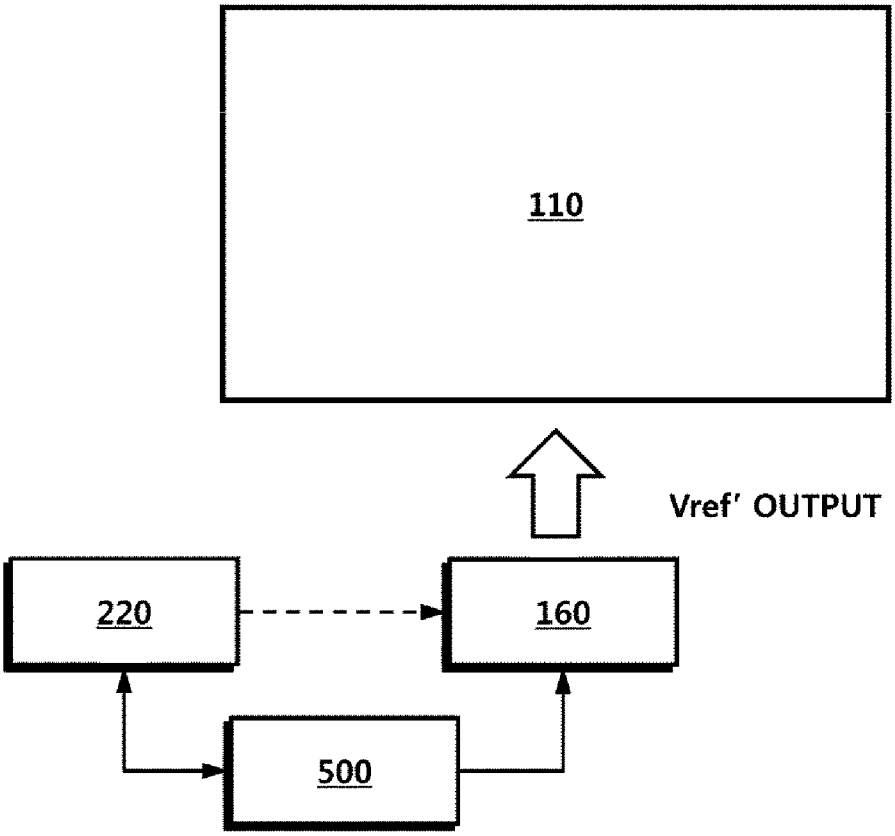
FIG. 5 schematically illustrates a dispersion shift compensation scheme in an organic light emitting display device according to an embodiment.
Figure 6:
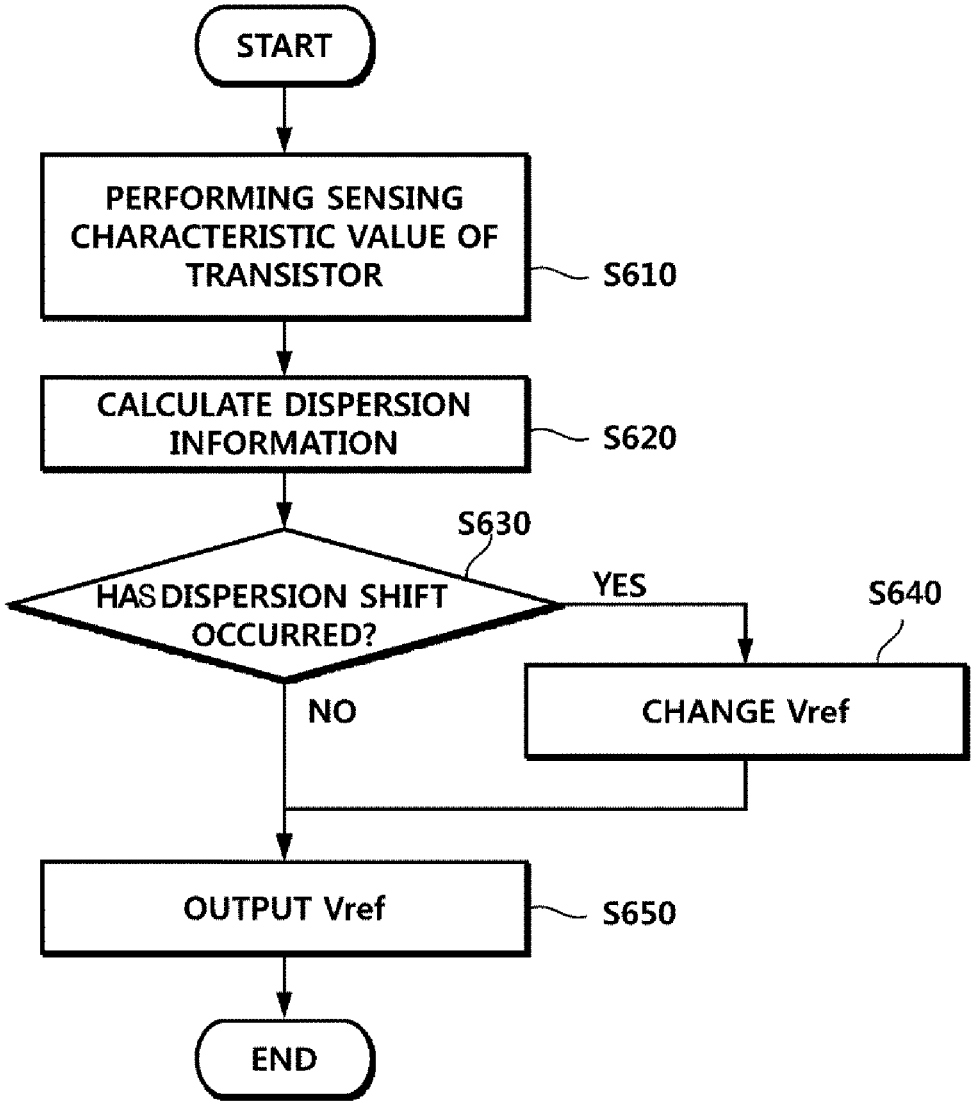
FIG. 6 is a flowchart of a dispersion shift compensation in an organic light emitting display device according to an embodiment.

FIGS. 5 and 6 are views for describing the dispersion shift compensation scheme in an organic light emitting display device 100 according to an embodiment.

Referring to FIG. 5, for the dispersion shift compensation scheme which compensates for the dispersion shift of the characteristic value of the driving transistor in each pixel of the organic light emitting display device 100 according to an embodiment, the compensation unit 220 may collect the characteristic values of the driving transistors sensed according to each pixel, calculate the dispersion information (e.g., the dispersion information may include an average value, and may further include a deviation), and control to change the reference voltage which is the common voltage of all pixels of the display panel 110, according to the result of the comparison between the calculated dispersion information with the predetermined reference dispersion information.

The dispersion shift compensation scheme is described in more detail with reference to FIG. 6.

The sensing unit 210 senses the characteristic values of the each driving transistor of the display panel 110 (S610).

After step S610, the compensation unit 220 calculates current dispersion information, based on the characteristic values of each driving transistor sensed by the sensing unit 210 (S620).

After step S620, the compensation unit 220 compares the calculated current dispersion information with the reference dispersion information pre-stored in a register (i.e., one type of small storage device, not shown), and determines whether the dispersion shift occurs (S630).

At this time, as a result of the comparison, when a difference between the calculated dispersion information and the reference dispersion information is within the predetermined range, the compensation unit 220 determines that the dispersion shift does not occur. As the result of the comparison, when the difference between the calculated dispersion information and the reference dispersion information is out of the predetermined range, the compensation unit 220 determines that the dispersion shift occurs.

After step S630, as a result of determining whether the dispersion shift occurs or not, when the dispersion shift does not occur, that is, the difference between the calculated dispersion information and the reference dispersion information is within the predetermined range, the compensation unit 220 does not change a register value pre-stored in a memory 500. Thus, the power providing unit 160 maintains the reference voltage Vref according to a register value which is pre-stored in the memory 500 and does not change (S650).

After step S630, as the result of determining whether the dispersion shift occurs or not, when the dispersion shift occurs, that is, the difference between the calculated dispersion information and the reference dispersion information is out of the predetermined range, the reference dispersion information which is pre-stored in the register is updated using the calculated dispersion information, and a reference voltage change value is determined so that the difference between the calculated dispersion information and the reference dispersion information is within the predetermined range. In addition, in order to control to change and output the reference voltage according to the determined reference voltage change value, a register value corresponding to the determined reference voltage change value is stored (i.e, updated) in the memory 500 (S650).

In the above, the dispersion shift compensation using the integrated pixel compensation scheme through the reference voltage change is described, with reference to FIGS. 4 to 6.

Hereinafter, a dispersion change in a broad sense having a concept of a dispersion shift (i.e. average value shift) is newly defined, and a compensation for the newly defined dispersion change is described.

Figure 7:
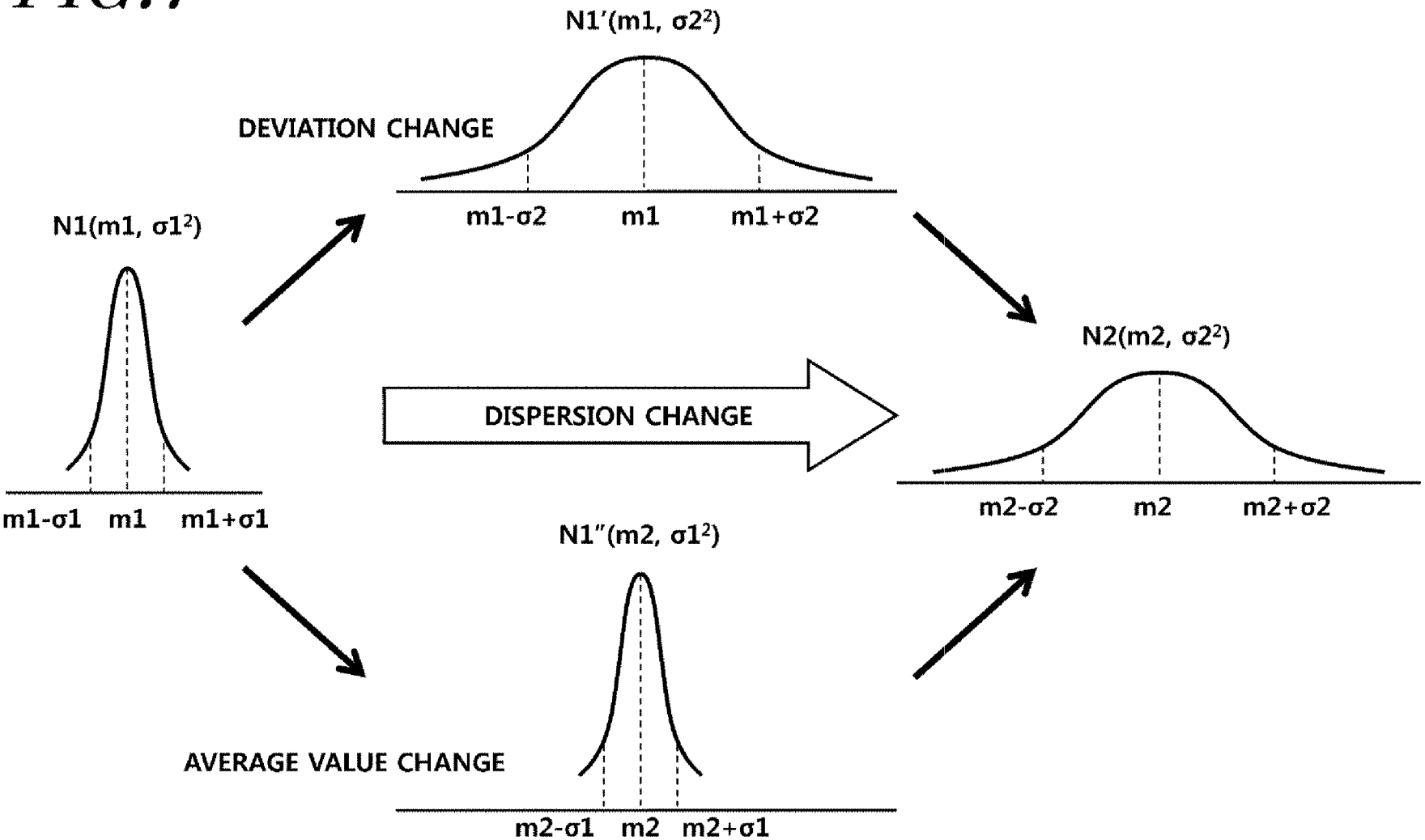
FIG. 7 is a view illustrating a dispersion change in a broad sense in an organic light emitting display device, as a dispersion curve.

Firstly, referring to FIG. 7, the dispersion change in a broad sense is defined.

FIG. 7 is a view illustrating the dispersion change in a broad sense in an organic light emitting display device 100, as a dispersion curve.

Referring to FIG. 7, in the organic light emitting display device 100 according to an embodiment, the dispersion change in a broad sense includes an average value change (i.e., average value shift) element and a deviation change element. Here, the average value (average value shift) element is a dispersion change in which only a change of an average value of a characteristic value of a driving transistor is considered. The deviation element is a dispersion change in which only a change of a deviation (i.e., difference) between the characteristic values of the driving transistors is considered.

Firstly, a deviation change element is described.

It is assumed that a dispersion change in which the characteristic values of each driving transistor is changed from N1(m1, $\sigma 1^2$) dispersion to N2(m2, $\sigma 2^2$) dispersion occurs, according to a driving time of each driving transistor, which is increased from a first time point to a second time point. When only a deviation change is considered in the dispersion change from N1(m1, $\sigma 1^2$) dispersion to N2(m2, $\sigma 2^2$) dispersion, the dispersion change is from N1(m1, $\sigma 1^2$) dispersion to N1'(m1, $\sigma 2^2$) dispersion. When only an average value is considered in the dispersion change from N1(m1, $\sigma 1^2$) dispersion to N2(m2, $\sigma 2^2$) dispersion, the dispersion change is from N1(m1, $\sigma 1^2$) dispersion to N1" (m2, $\sigma 1^2$) dispersion.

Figure 8A:
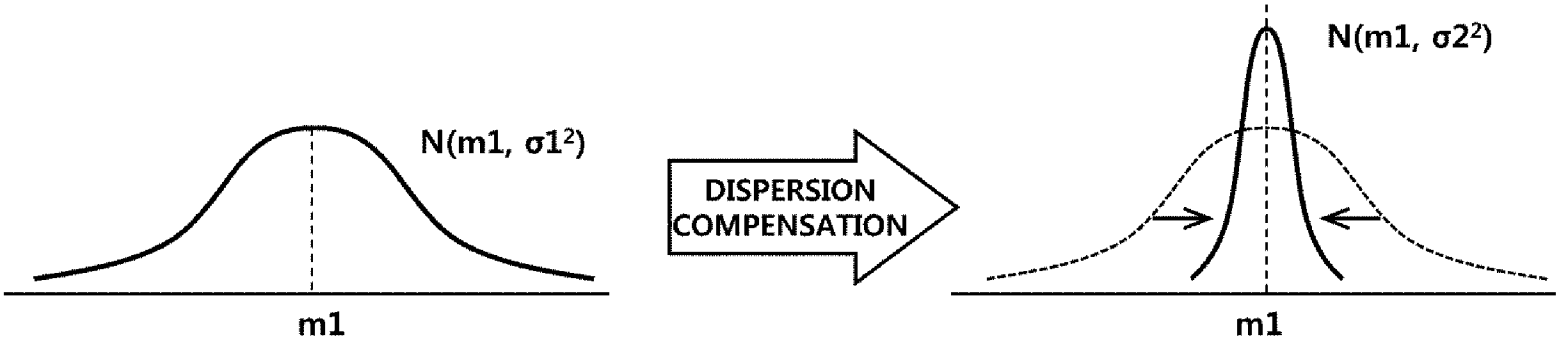
FIGS. 8A and 8B are views illustrating two types of dispersion change compensations in an organic light emitting display device according to an embodiment.
Figure 8B:
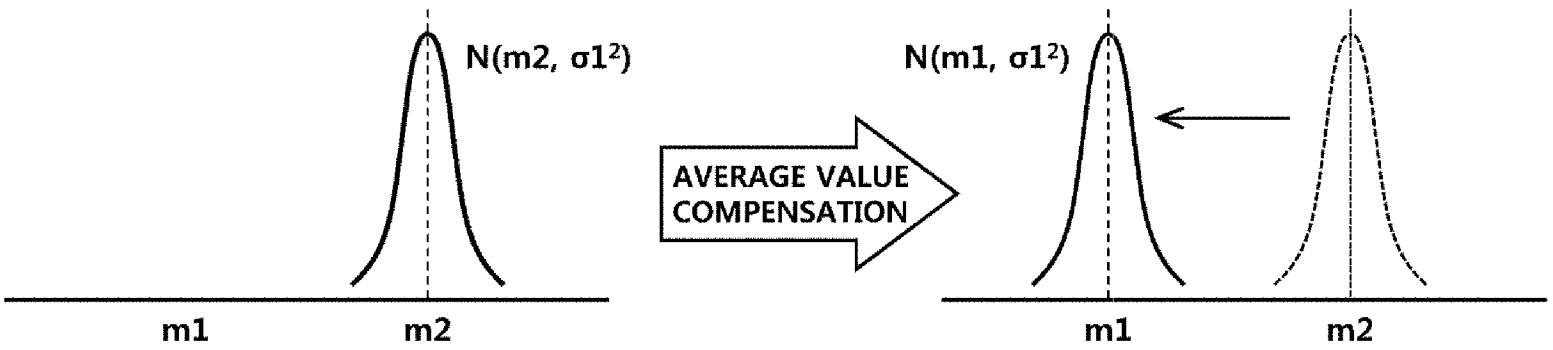

The dispersion change compensation also includes a deviation change compensation and an average value change compensation as shown in FIGS. 8A and 8B, according to a conceptual meaning of the dispersion change. In the dispersion change compensation, the deviation change compensation is referred to as a deviation compensation or a dispersion compensation, and the average change compensation is referred to as an average value compensation, an average value shift compensation or a dispersion shift compensation.

FIGS. 8A and 8B are views illustrating two types of dispersion change compensations in an organic light emitting display device 100 according to an embodiment.

FIG. 8A is a view illustrating the deviation change compensation (i.e., dispersion compensation) which compensates for only a deviation change element in the dispersion change. FIG. 8B is a view illustrating the average value change compensation which compensates for only an average value change element in the dispersion change.

The deviation change compensation (i.e., dispersion compensation) shown in FIG. 8A may be performed by the individual pixel compensation scheme. The average value change compensation shown in FIG. 8B may be performed by the integrated pixel compensation scheme.

Such a dispersion change compensation and a compensation unit 220 related to the dispersion change compensation are described with reference to FIG. 9.

Figure 9:
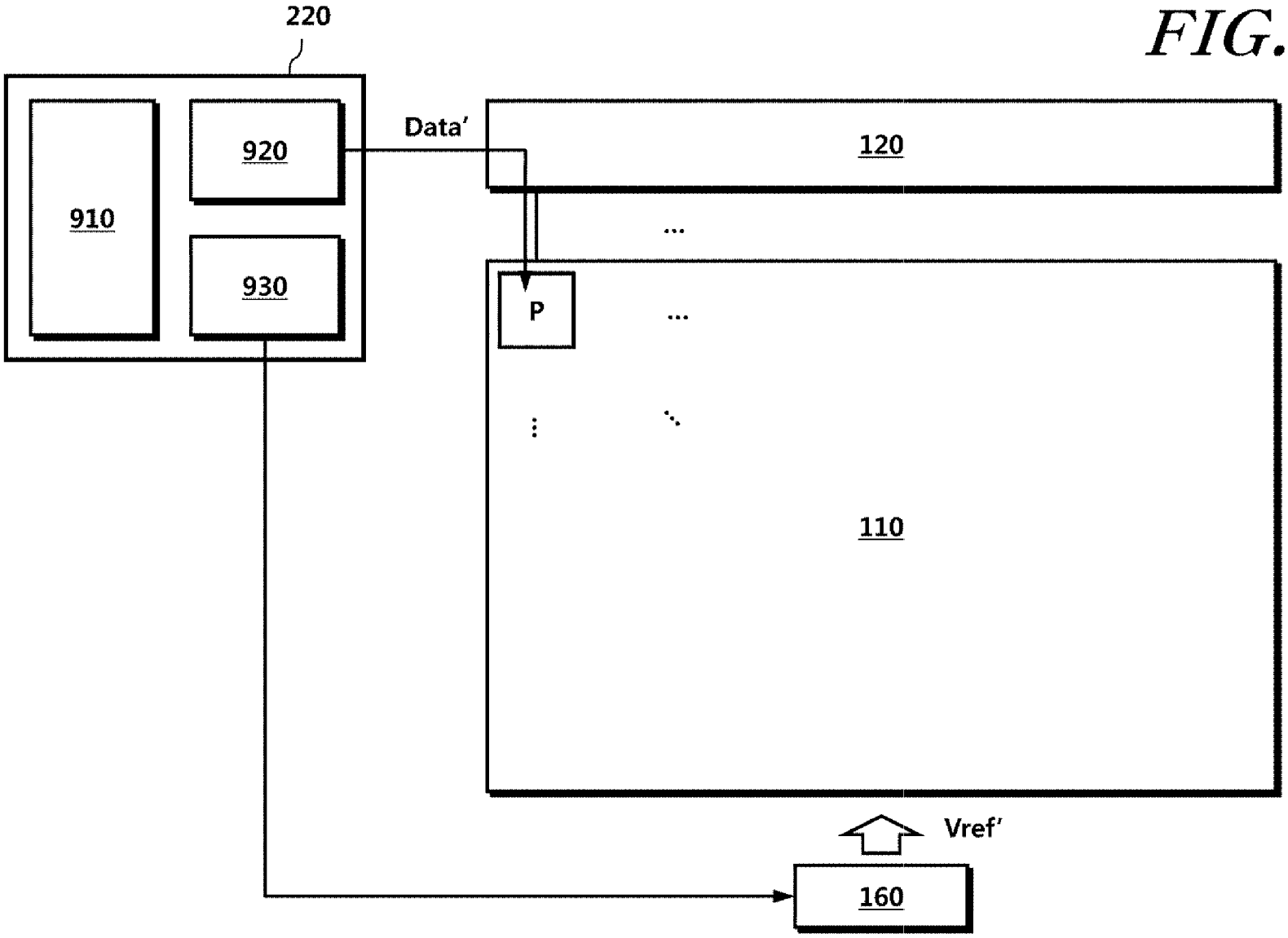
FIG. 9 is a view for schematically describing a dispersion change compensation in an organic light emitting display device according to an embodiment.

FIG. 9 is a view for schematically describing a dispersion change compensation in an organic light emitting display device according to an embodiment.

Referring to FIG. 9, the compensation unit 220 includes a calculation unit 910 which calculates dispersion information from a characteristic value of the driving transistor sensed according to each pixel, and a first compensation unit 920 for the deviation compensation (i.e. dispersion compensation), and a second compensation unit 930 for the average value compensation.

The calculation unit 910 calculates the dispersion information including the average value and the deviation of the driving transistor, which is sensed according to each pixel.

The first compensation unit 920 compensates for the deviation of the characteristic values sensed according to each pixel, with reference to the calculated dispersion information (i.e., the deviation) and a reference dispersion information (i.e, previously calculated dispersion information or set target dispersion information).

The first compensation unit 920 outputs change information Data' marked as a reference numeral 240 of FIG. 2 of a data voltage provided to a corresponding pixel, so that the deviation of the characteristic values sensed according to the each pixel is compensated to a reference deviation (i.e., a deviation of previously sensed characteristic values or a set target deviation). Thus, the data driving unit 120 provides the changed data voltage Vdata' to the corresponding pixel P.

The second compensation unit 920 compensates for the average value of the characteristic values sensed according to each pixel, with reference to the calculated dispersion information (i.e., the average value) and the reference dispersion information (i.e, previously calculated dispersion information or set target dispersion information).

The second compensation unit 920 outputs a change value of the reference voltage Vref commonly provided to all pixels of the display panel 110 or corresponding information corresponding to the change value of the reference voltage Vref, so that the average value of the characteristic values sensed according to each pixel is compensated to a reference average value (i.e, an average value of previously sensed characteristic values or a set target average value). Thus, the power providing unit 160 provides the changed reference voltage Vref' to the all pixels.

Figure 10:
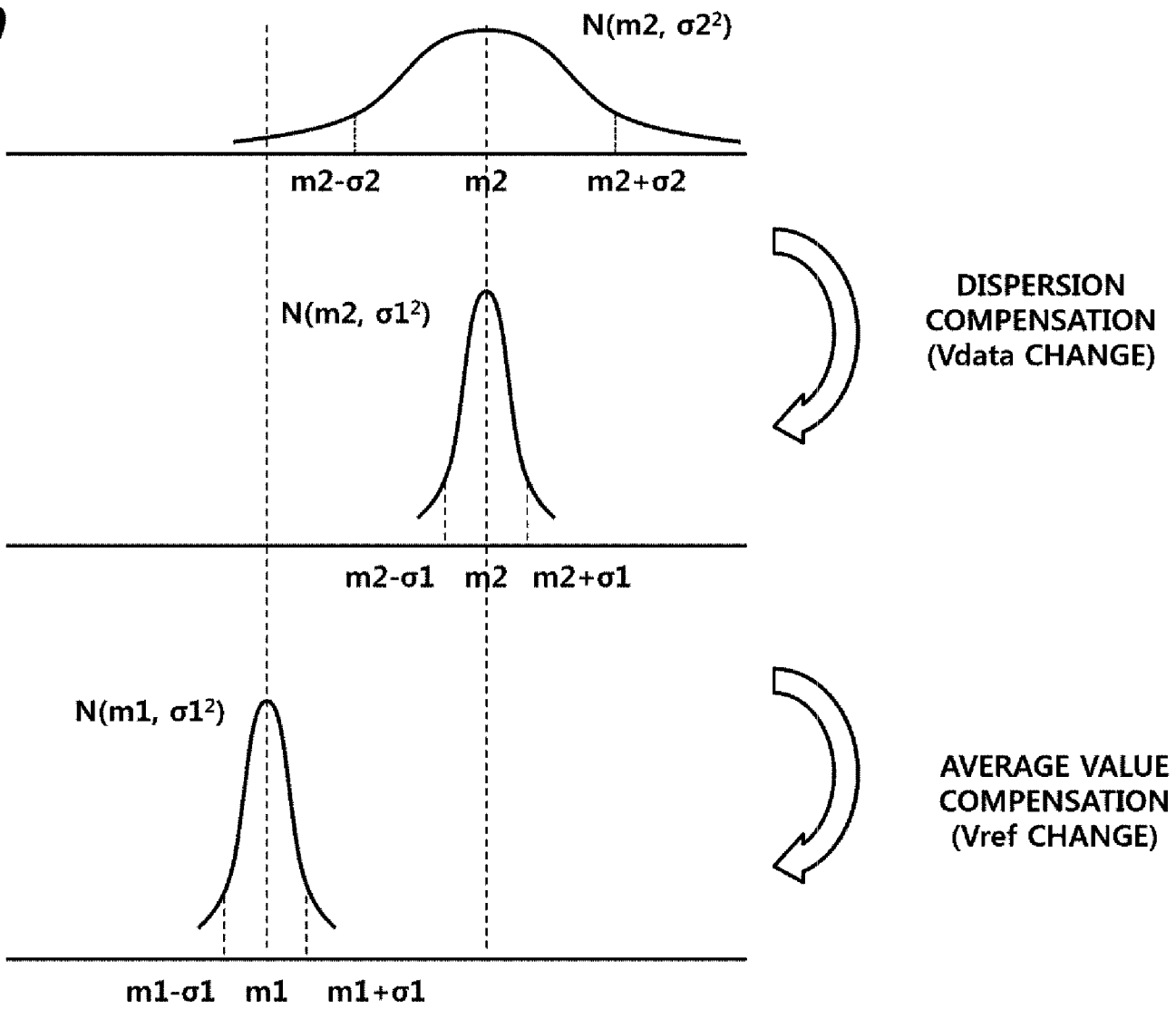
FIG. 10 is a view illustrating a change of a dispersion curve in stages according to a dispersion change compensation (i.e., dispersion compensation and average value compensation) in an organic light emitting display device according to an embodiment.

Meanwhile, as shown in FIG. 7, when the dispersion change includes both of the deviation change element and the average value change element, the deviation compensation (i.e., dispersion compensation) and the average value compensation are simultaneously performed. However, for convenience of description, it is assumed that the deviation compensation (i.e., dispersion compensation) is firstly performed and the average value compensation is performed after the deviation compensation. FIG. 10 illustrates a change of a dispersion curve in stages.

Hereinafter, a current Ids flowing through the driving transistor related to the above-mentioned dispersion change compensation is described.

Firstly, when there is no dispersion change compensation, the current Ids flowing through the driving transistor may be expressed as Equation 1.

$$Ids=K/2(Vgs-Vth)^2=K/2(Vdata-Vref-Vth)^2 \quad \text{Equation 1}$$

Meanwhile, when only a dispersion compensation (i.e., deviation compensation) in a dispersion change compensation is considered, that is, only the data voltage is changed, the current Ids flowing through the driving transistor may be expressed as Equation 2.

$$\begin{aligned} Ids &= K/2(Vgs-Vth)^2 \quad \text{Equation 2} \\ &= K/2(Vdata' - Vref - Vth)^2 \\ &= K/2((Vdata+\alpha) - Vref - Vth)^2 \end{aligned}$$

Meanwhile, when only an average value compensation in the dispersion change compensation is considered, that is, only the reference voltage is changed, the current Ids flowing through the driving transistor may be expressed as Equation 3.

$$\begin{aligned} Ids &= K/2(Vgs-Vth)^2 \quad \text{Equation 3} \\ &= K/2(Vdata - Vref' - Vth)^2 \\ &= K/2(Vdata - (Vref+\beta) - Vth)^2 \end{aligned}$$

Meanwhile, when both a dispersion compensation and an average value compensation in the dispersion change compensation are considered, that is, both the data voltage and the reference voltage are changed, the current Ids flowing through the driving transistor may be expressed as Equation 4.

$$Ids = K/2(Vgs - Vth)^2 \quad \text{Equation 4}$$
$$= K/2(Vdata' - Vref' - Vth)^2$$
$$= K/2((Vdata + \alpha) - (Vref + \beta) - Vth)^2$$

In the above-mentioned Equations 1 to 4, Vgs is a voltage difference between the first node N1 the second node N2 of the driving transistor, Vth is a threshold voltage of the driving transistor, and K is μCox W/L. Here, K is an element of a mobility of the driving transistor, μ is the mobility of the driving transistor, Cox is an oxide capacitance of the driving transistor, W is a channel width of the driving transistor, and the L is a channel length of the driving transistor.

In the above-mentioned Equations 2 to 4, α is a dispersion compensation value for a dispersion compensation (i.e. deviation compensation), and is provided from a Source Integrated Circuit (S-IC) of the data driving unit 120, as a voltage value which is added with the data voltage Vdata. β is an average value compensation value for an average value compensation, and corresponds to a difference between a previous reference voltage Vref and a direct current reference voltage (Vref+β) which is currently provided from the power providing unit 160.

Meanwhile, as described above, when the dispersion change compensation according to an embodiment is performed, a range capable of controlling the data voltage of the S-IC in the data driving unit 120 can be expanded. This will be described with reference to FIG. 11.

Figure 11:
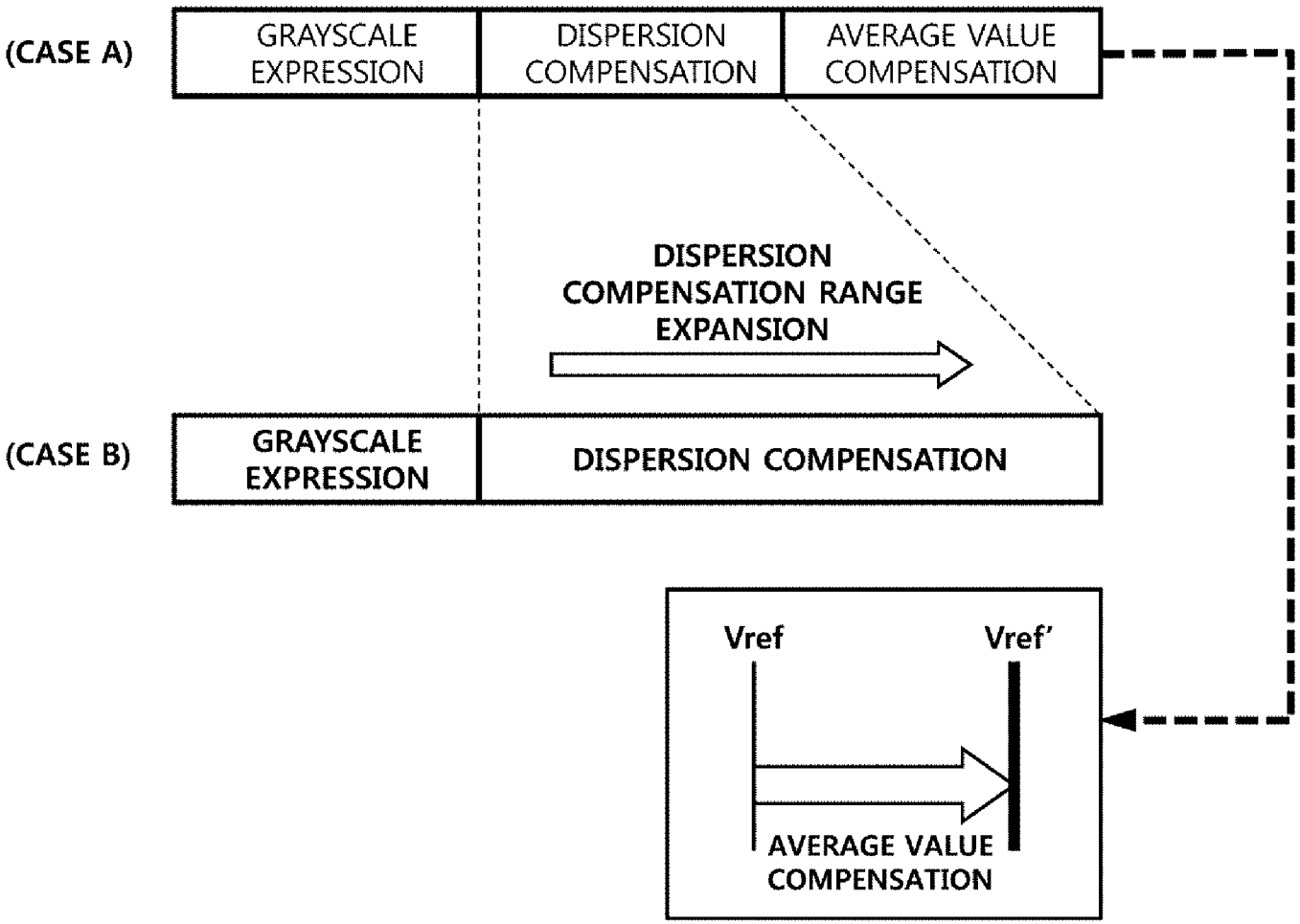
FIG. 11 is a view for describing a compensation range expansion in a data driving unit in accordance with a dispersion change compensation according to an embodiment.

FIG. 11 is a view for describing a compensation range expansion in the data driving unit 120 in accordance with the dispersion change compensation according to an embodiment.

Referring to Case A in FIG. 11, when the dispersion change compensation according to an embodiment is not applied to the data driving unit 120, in order to control a data voltage to be output, and when all of a gradation expression, the dispersion compensation and the average value compensation are considered, the S-IC of the data driving unit 120 can control the data voltage within a data voltage range including a first voltage range allocated for the gradation expression, a second voltage range allocated for the dispersion compensation (i.e., deviation compensation) and a third voltage range allocated for the average value compensation, to provide the data voltage to a corresponding pixel.

Referring to Case B in FIG. 11, when the dispersion change compensation according to an embodiment is applied to the data driving unit 120, the S-IC of the data driving unit 120 can provide the data voltage changed within a first voltage range allocated for the gradation expression and a second voltage range allocated for the dispersion compensation (i.e., deviation compensation), to each pixel.

Comparing Case A with Case B, when the dispersion change compensation according to an embodiment is applied to the data driving unit 120, since the S-IC of the data driving unit 120 does not have to consider the average value compensation, the second voltage range for the dispersion compensation can be more widely expanded. That is, since a deviation of the characteristic values which may be compensated becomes larger, a compensation possible range becomes wider, and thus a compensation for a deviation which cannot be compensated in the prior art can be compensated.

That is, since the dispersion compensation (i.e., deviation compensation) is performed according to the individual pixel through the data voltage change, and the average value compensation is performed on all pixels at once by changing the reference voltage Vref which is the common voltage commonly provided to all pixels, the S-IC in the data driving unit 120 considers the gradation expression and the dispersion compensation in order to control the data voltage and does not have to consider the average value compensation, and thus the range in which the data voltage is controlled by the S-IC can be expanded.

To summarize the embodiment described above, the organic light emitting display device 100 includes the display panel 110 including the data lines and the gate lines defining the plurality of pixels, the data driving unit 120 providing the data voltage to the data lines, and the power providing unit 160 changing the reference voltage commonly provided to the driving transistors DT in each of the plurality of pixels to output the changed reference voltage.

The power providing unit 160 may change and output the reference voltage according to the average value for the characteristic values of the driving transistors DT in each pixel.

The data driving unit 120 may change and provide the data voltage according to the deviation for the characteristic values of the driving transistors DT in the each pixel.

As described above, according to the present invention, the organic light emitting display device 100 capable of effectively compensating for the dispersion and the dispersion shift of the characteristic value of the driving transistor can be provided.

In addition, according to the present invention, the organic light emitting display device 100 capable of preventing a phenomenon in which an undesirable color is displayed according to a characteristic value shift of a driving transistor, through a dispersion change compensation, can be provided.

In addition, according to the present invention, the display panel and the organic light emitting display device 100 of which a reliability is high and a lifetime is long can be provided, through an effective pixel compensation.

While the technical spirit of the present invention has been exemplarily described with reference to the accompanying drawings, it will be understood by a person skilled in the art that the present invention may be varied and modified in various forms without departing from the scope of the present invention. Accordingly, the embodiments disclosed in the present invention are merely to describe, but not limit, the technical spirit of the present invention. Further, the scope of the technical spirit of the present invention is not limited by the embodiments. The scope of the present invention shall be construed on the basis of the accompanying claims in such a manner that all of the technical ideas included within the scope equivalent to the claims belong to the present invention.

What is claimed is:

1. An organic light emitting display device comprising:

a sensor that senses characteristic values of each of a plurality of driving transistors for each pixel of a plurality of pixels in a display panel, wherein the characteristic values are at least one of threshold voltage and mobility of each of the plurality of driving transistors; and a compensator that: (i) acquires compensation dispersion information including a deviation value of each driving transistor calculated based on a characteristic value of each of the plurality of driving transistors in the plurality of pixels and an average value calculated based on the characteristic value of each of the plurality of driving transistors in the plurality of pixels, and then by comparing at least one of the average value and the deviation values of the compensation dispersion information with pre-stored reference dispersion information, determines that at least one of an average value shift and a deviation change occurs when a difference between at least one of the average value and a deviation value of the compensation dispersion information and the pre-stored reference dispersion information is outside a predetermined range, determines, for the average value shift, a reference voltage change value so that the difference between the average value and a reference voltage value is within the predetermined range, and determines, for the deviation value, a deviation compensation so the difference between the deviation value and the reference deviation is within the predetermined range; and (ii) compensates for at least one of the average value shift by controlling a common reference voltage applied to a driving transistor in each pixel of the plurality of pixels according to the reference voltage change value and compensates for the deviation change of the driving transistor by controlling a data voltage applied to the transistor according to the reference deviation such that:

when there is no dispersion change, a current Ids flowing through the driving transistor satisfies Equation 1:

$$Ids=K/2(Vgs-Vth)^2=K/2(Vdata-Vref-Vth)^2 \quad \text{(Equation 1);}$$

when only a deviation change of the dispersion change is compensated for, the current Ids flowing through the driving transistor satisfies Equation 2:

$$\begin{aligned} Ids &= K/2(Vgs - Vth)^2 \quad \text{(Equation 2)} \\ &= K/2(Vdata' - Vref - Vth)^2 \\ &= K/2((Vdata + \alpha) - Vref - Vth)^2; \end{aligned}$$

when only the average value of the dispersion change is compensated for, the current Ids flowing through the driving transistor satisfies Equation 3:

$$\begin{aligned} Ids &= K/2(Vgs - Vth)^2 \quad \text{(Equation 3)} \\ &= K/2(Vdata - Vref - Vth)^2 \\ &= K/2(Vdata - (Vref + \beta) - Vth)^2; \end{aligned}$$

wherein in Equations 1 to 3, Vgs is a voltage difference between a first node N1 and a second node N2 of the driving transistor; Vth is a threshold voltage of the driving transistor; K is an element of a mobility of the driving transistor represented by μCox W/L, where μ is the mobility, Cox is an oxide capacitance, W is a channel width, and L is a channel length; α is the deviation compensation compensating to the reference deviation as a voltage value which is added with a data voltage Vdata and provided by a Source Integrated Circuit (S-IC) of the data driving unit; β is the average value of the dispersion compensation, and which corresponds to a difference between a reference voltage Vref and a direct current reference voltage (Vref+β) which is currently provided from a power providing unit; Vdata' is a changed data voltage; and Vref' is a changed reference voltage, wherein the compensator comprises a calculation unit that calculates the compensation dispersion information, a first compensator that compensates for a change in the deviation value, and a second compensator that compensates for a change in the average value.

2. The organic light emitting display device of claim 1, wherein for Equations 2 and 3, the compensator changes at least one of the common reference voltage and the data voltage to reduce the dispersion change to be within the predetermined range, according to the reference voltage change value.

3. The organic light emitting display device of claim 1, wherein a first compensator changes the data voltage of each pixel to compensate for the change in the deviation value, and a second compensator changes the common voltage provided to each pixel of the plurality of pixels to compensate for the change in the average value.

4. The organic light emitting display device of claim 3, further comprising:

a data driver that provides the data voltage to each pixel, wherein the data voltage is within a data voltage range, including a first voltage range for a grayscale expression and a second voltage range for a deviation compensation.

5. The organic light emitting display device of claim 3, wherein when the deviation value changes, the first compensator compensates by changing the data voltage applied to each pixel of the plurality of pixels, wherein when the average value changes, the second compensator compensates by changing the common voltage of each pixel, and wherein when both the average value and the deviation value change, both the first and second compensators compensate by changing both the data voltage of each pixel and the common reference voltage, respectively, applied to each pixel.

* * * * *